United States Patent [19]

Janssen

[11] Patent Number: 4,756,340

[45] Date of Patent: Jul. 12, 1988

[54] JACQUARED DOUBLE PLUSH FABRIC

[75] Inventor: Herbert Janssen, Xanten, Fed. Rep. of Germany

[73] Assignee: Caesarea Glenoit Industries Ltd., Tel Aviv, Israel

[21] Appl. No.: 73,907

[22] Filed: Jul. 13, 1987

Related U.S. Application Data

[63] Continuation of Ser. No. 777,824, Sep. 19, 1985.

[30] Foreign Application Priority Data

Sep. 19, 1984 [DE] Fed. Rep. of Germany ..... 3434351

[51] Int. Cl.[4] ..... D03D 27/06; D03D 27/10

[52] U.S. Cl. ..... 139/397; 139/398

[58] Field of Search ..... 139/21, 397, 398, 391, 139/392, 407, 410

[56] References Cited

U.S. PATENT DOCUMENTS

| | | | |
|---|---|---|---|
| 1,143,192 | 6/1915 | Hammer | 139/398 |
| 2,101,286 | 12/1937 | Theunissen | 139/398 |
| 2,735,452 | 2/1956 | Hellebrekers | 139/397 |
| 3,014,502 | 12/1961 | Valentine | 139/21 |
| 3,327,738 | 6/1967 | Sabbe | 139/21 X |

FOREIGN PATENT DOCUMENTS

| | | | |
|---|---|---|---|
| 896102 | 7/1983 | Belgium | 139/398 |
| 119184 | 9/1984 | European Pat. Off. | 139/398 |
| 303027 | 10/1965 | Netherlands | 139/397 |

*Primary Examiner*—Stephen Marcus
*Assistant Examiner*—T. Graveline
*Attorney, Agent, or Firm*—Herbert L. Lerner; Laurence A. Greenberg

[57] ABSTRACT

A Jacquard double plush fabric for subsequent division into upper and lower fabric portions includes a plurality of sheds with a single weft for each of the sheds and a U-shaped pile thread for the respective single weft, and dead thread groups woven into and distributed within the upper and the lower fabric portions, and a method and an apparatus for producing the fabric.

4 Claims, 3 Drawing Sheets

JACQUARED DOUBLE PLUSH FABRIC

This application is a continuation of application Ser. No. 777,824, filed Sept. 19, 1985.

The invention relates to a Jacquard double plush fabric for subsequent division into upper and lower fabric portions having a construction including a single weft for each shed and a U-shaped pile thread for each weft. More particularly, the invention relates to a double plush carpet, a method for making the Jacquard double plush fabric or carpet, and an apparatus for carrying out the method.

In the production of a double plush fabric, two fabric portions are woven one above another and connected together by additionally and simultaneously woven-in pile threads. In the finished double fabric, the perpendicular pile threads are separated by cutting between the upper and lower fabrics, so that two fabric sheets with projecting or upstanding threads on one side thereof i.e. the nap, are produced.

For binding-in the pile threads which connect the two basic fabrics, a single-weft pile construction with single-shed weft infeed of the type mentioned at the introduction hereto may be employed, threads floating within the base fabric of which groups of threads floating within the base fabric, however, respectively lying against the back of the lower fabric. These temporarily or periodically non-working threads floating within the base fabric groups, which float on the rear face of the lower fabric, must later be scraped away.

In the course of the scraping, the half pile threads or naps which occur at the pile change positions are also pulled out. For each thread group change, the lower fabric therefore exhibits a fault on the corresponding weft. In spite of the inferior lower fabric, the single-weft pile construction with threads floating within the base fabric groups of threads floating on the lower face is even now yet mainly used for manufacturing double carpet plush and the like in many countries, because the corresponding weaving technology is simple and a standard high-shed Jacquard machine is sufficient for forming the shed. Furthermore, the production rate with the single-weft pile construction is relatively high, because each weft carries a row of nap, with the result that a relatively dense nap covering can be achieved without requiring additional auxiliary wefts to be introduced.

In order to counteract the disadvantage of the inferior lower fabric resulting with the conventional single-weft pile construction, the three-weft pile through-construction which can likewise be woven by single-shed weft infeed on a standard high-shed machine could be used. With this construction, unlike the conventional single-weft pile construction, it is possible to shift the pile change points or locations to two different wefts into the upper fabric portion. Although, with this construction, the threads floating within the base fabric groups of threads floating within the base fabric again lie on the rear face of the lower fabric portion and must be scraped away, no faults are produced in the lower fabric portion during the scraping operation. The benefit of this construction is obtained at the cost of production losses and also the loss of much valuable pile material in the formation of the pile through-nap and, of course, in the scraping-off of the groups of threads floating within the base fabric.

In both of the aforementioned construction, the groups of threads floating on the rear of the lower fabric portion can only be considered as waste material. In order to avoid this loss and, instead, to improve the quality of the carpet with the valuable pile material, a two-weft construction has been developed, which can be woven by single-shed weft infeed and in which the groups of floating threads are woven-in suitably distributed over the upper and lower fabrics. In this regard, upper and lower fabrics become of equal weight, and the fabric appears in a very clear view or image on the front and rear faces. However, in the upper and lower fabric portions, a total of four wefts are necessary in order to form a complete pile nap. For each weft, a single Jacquard card is necessary, and is pressed on between the wefts. Because, for this purpose, the hooks on the blade frame always have to be moved into the lowered position for reading, a complete upward and downward movement of the blade frame is necessary for each revolution of the machine and, as a result, the rotational speed of the standard high-shed machine, which is also used in this regard, is approximately reduced in half when compared with the case of single-weft construction.

Therefore, in order to increase the output in the weaving of double plush fabric, various different types of weaving with double-shed weft infeed are used. Obviously, a much higher productivity can be achieved if two wefts, instead of only one, can be introduced simultaneously and above one another and, respectively, woven alternately into the upper and lower fabric portions for every revolution of the automatic loom. In the simplest type of this technique, namely two-weft construction which can be woven by double-shed weft infeed, however, either mixed contours appear in the through-weaving or standing pile and split naps in the half through-weaving, and thus a rough upper face is produced.

Three-weft construction with double-shed weft infeed, most commonly employed today in carpet factories, was therefore created. In this weaving technique, between the two wefts of the two-weft construction, an additional third weft is introduced, which covers the dead thread groups on the lower face or underside of the carpet and prevents pushing through. Although three wefts are required for forming a pile nap and, therefore, a relatively low productivity is achieved, there exists no technically, aesthetically and economically satisfactory alternative to this three-weft construction.

It is accordingly an object of the invention to provide a construction which combines the advantages of the three-weft construction, which can be woven by double-shed weft infeed, with the advantages of a construction which can be produced by single-shed weft infeed, in which, therefore, a pulling-through of the dead thread groups also does not occur and mixed contours do not arise, yet the number of wefts per pile nap is reduced to a minimum. Furthermore, in spite of the use of a single-shed weft infeed apparatus, it is possible thereby to produce clear patterns or images on the front and rear faces of upper and lower fabric portions.

With the foregoing and other objects in view, there is provided, in accordance with the invention, a Jacquard double plush fabric for subsequent division into upper and lower fabric portions, comprising a single weft for each shed and a U-shaped pile thread for each weft, and groups of floating threads woven into and distributed within the upper and lower fabric portions.

In accordance with another feature of the invention, there is provided a double plush fabric in which a continuous pile thread constituting the upper and lower fabric portion extends alternately into both fabric portions, the continuous pile thread passing about a continuous series of sequences of wefts, each sequence including two lower wefts of the two fabric portions and two upper wefts of the two portions, at least one floating thread passing between adjacent upper and lower wefts of each sequence, lower and upper wefts of each fabric portion binding in the floating thread groups and securing the U-shaped pile threads.

In accordance with another aspect of the invention, there is provided a method of manufacturing a double plush fabric of the invention which comprises controlling all of the floating thread groups by a separate Jacquard card sheet for each upper and lower weft in the upper and lower fabric portions.

In this manner, a result is attained that a double plush fabric, which can be woven by a single-shed weft infeed apparatus, can be made with single-weft construction with no thread wastage in the upper and lower fabric portions or completely equal thread wastage therein. The invention therefore combines the advantages:

(a) of the conventional single-weft pile construction which can be woven with single-shed weft infeed without the disadvantage of the floating thread groups floating on the rear of the lower fabric portion;

(b) of the through-woven, two-weft construction, which likewise can be woven with single-shed weft infeed, with the number of wefts reduced to one half; and (c) of the through-woven, three-weft construction, which can be formed with two-shed weft infeed, by means of a quite considerably less costly machine, for example, in accordance with the invention, instead of one operator per conventional double-shed machine, only one operator for two or more machines is required.

In the method according to this invention, a new card reading is necessary for every weft. For carrying out such a process in the production of a single-shed weft infeed standard weave, double-lift, fully-open shed Jacquard machines are used in conjunction with the corresponding loom. The hook stroke of a conventional Jacquard machine of this type is insufficient, however, for weaving a double weave. Because the double-lift, fully-open shed Jacquard machine has a blade frame stroke adapted for the production of single weaves, the stroke height of the harness cords with pile strand and weight and so forth suspended therefrom, thus also of the hooks and therefore of the blade frames, must be approximately doubled when used for double plush weaving. Because the lengthened stroke travel must be covered in a substantially unchanged time, if the production rate is not to be reduced, quite considerable forces, amounting to many tons in the case of machines which are several meters wide, have to be accepted by the mechanism of the machine.

Therefore, in accordance with a further aspect of this invention, there is provided a loom constructed for the production of a double plush fabric with single-shed weft infeed and single-weft pile construction operatable with a double-lift, fully-open shed Jacquard machine equipped essentially only for standard fabric, if a lifting pulley is suspended from each hook or plate, the appertaining harness cord being passed over the pulley and being connected, by the end thereof located opposite to the pile strand thereof, firmly to the machine frame. When raising and lowering a hook through the hook stroke which is usual in the production of a standard weave, the harness cord with pile strand is moved up and down i.e. reciprocated, under these circumstances, over a distance corresponding to twice that of the hook stroke (at twice the speed).

The individual hook must, indeed additionally accompany the lifting pulley, in this solution, but it is relieved of half the weight of harness cord, pile strand and harness weight. In this manner, it becomes possible, with a double-lift, fully-open shed Jacquard machine designed for standard and single weave, respectively, to produce double plush fabric with single-shed weft infeed and with single-weft construction with thread floating within the base fabric groups woven-in in a distributed manner over the upper and lower fabric portions. The construction according to this invention can be woven, therefore, with essentially mass-produced machines, if the hook and harness cord of the respective Jacquard machine are connected to one another by the aforementioned lifting pulley.

For each weft to be fed in, a separate perforated or punched card must be used for the manufacture of the fabric according to the invention. The perforated card should also be scanned for each revolution of the loom, in order to control the necessary movements of the thread groups also with regard to the fact that at any one time one half of the floating groups on average is being woven, respectively, into the upper and lower fabric portions. Programming of the punched cards may be performed in a conventional manner by means of a card puncher, manually or by computer.

Other features which are considered as characteristic for the invention are set forth in the appended claims.

Although the invention is illustrated and described herein as embodied in a Jacquard double plush fabric, method of making the fabric and apparatus for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
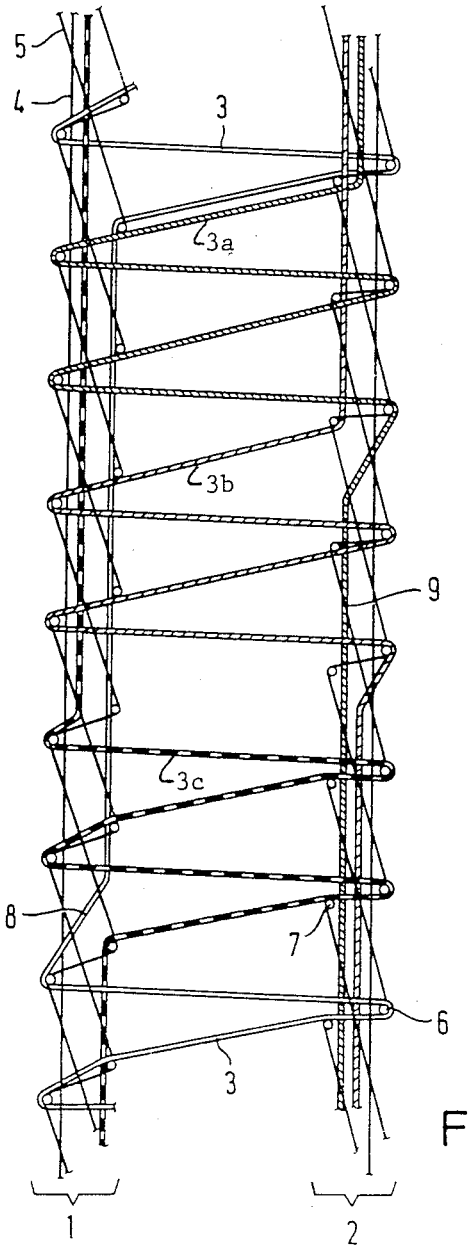
PRIOR ART FIG. 1
FIG. 1 is a diagrammatic view of a through-woven, two-weft double plush fabric construction with single-shed weft infeed as known in the prior art.
Figure 2:
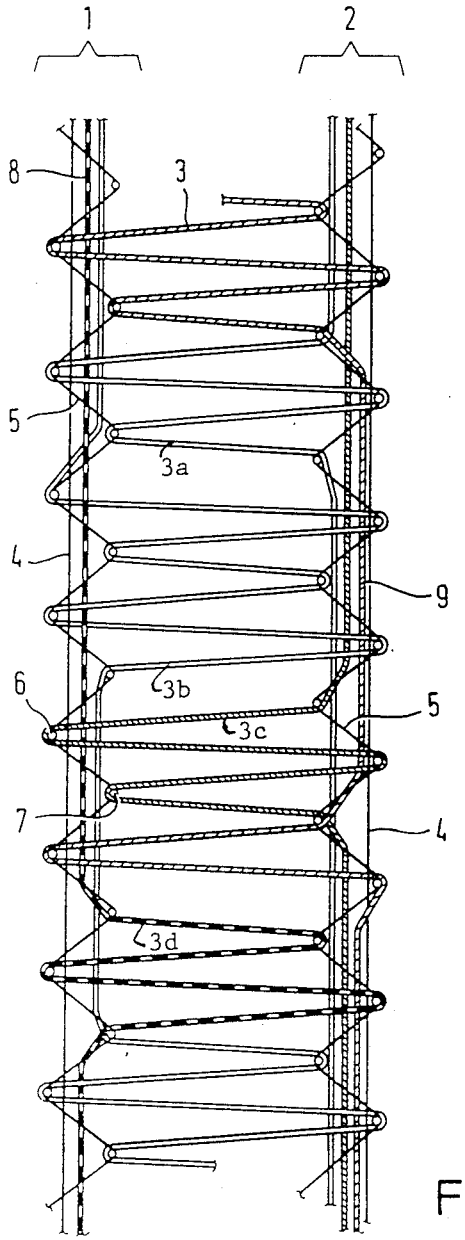
FIG. 2 is a view similar to that of FIG. 1 of a single weft construction according to the invention.

Whereas two wefts are necessary, respectively, for the construction of a pile nap in upper and lower fabric portions, for the through-woven, two-weft construction with single-shed weft infeed according to FIG. 1, only one weft is required for a pile nap in upper or lower fabric portions in the through-woven construction according to the invention having a single-shed weft infeed according to FIG. 2.

Referring then more particularly to the drawing, there is shown, in the construction according to FIGS. 1 and 2, pile threads 3 and 3*a* to 3*d* situated between an upper fabric portion 1 and a lower fabric portion 2, these pile threads 3 and 3*a* to 3*d* to be severed at the middle thereof after weaving. The upper fabric portion 1 and the lower fabric portion 2 also contain a basic warp 4 and a stitching warp 5. The weft construction in the upper fabric portion 1 and the lower fabric portion 2 is formed, respectively, of alternately fed-in lower weft 6 and upper weft 7. The floating thread groups 8 and 9 are, on average, each woven approximately one half into the upper fabric portion 1 and one half into the lower fabric portion 2. A considerable difference between the constructions according to FIGS. 1 and 2 is that, in the conventional two-weft construction of FIG. 1, the upper wefts 7 have only the function of binding-in the groups 8 and 9, whereas the upper wefts 7 (see FIG. 2) according to the invention (as in all cases also the lower wefts 6) also fulfill the function of, respectively, forming a pile nap.

A special feature of the single-weft construction to be formed according to the invention by single-shed weft infeed is that the floating thread groups 8 and 9 are woven, on average, in approximately equal proportions into the upper and lower fabrics 1 and 2. According to the invention, the weaving-in of the floating thread groups 8 and 9 distributed over the upper and lower fabrics 1 and 2 is achieved, in a manner similar to that for the two-weft construction of FIG. 2 which can be formed with a single-shed weft infeed, in that for each weft one Jacquard card sheet is programmed and read. Because a pile nap is produced with each weft, in accordance with the invention, the output is considerably higher than with the construction according to FIG. 1. It is equally as high as for the output of the conventionals single-weft pile construction which may be formed by single-shed weft infeed, with threads floating within the base fabric groups floating on the rear face of the lower fabric portion.

Figure 3:
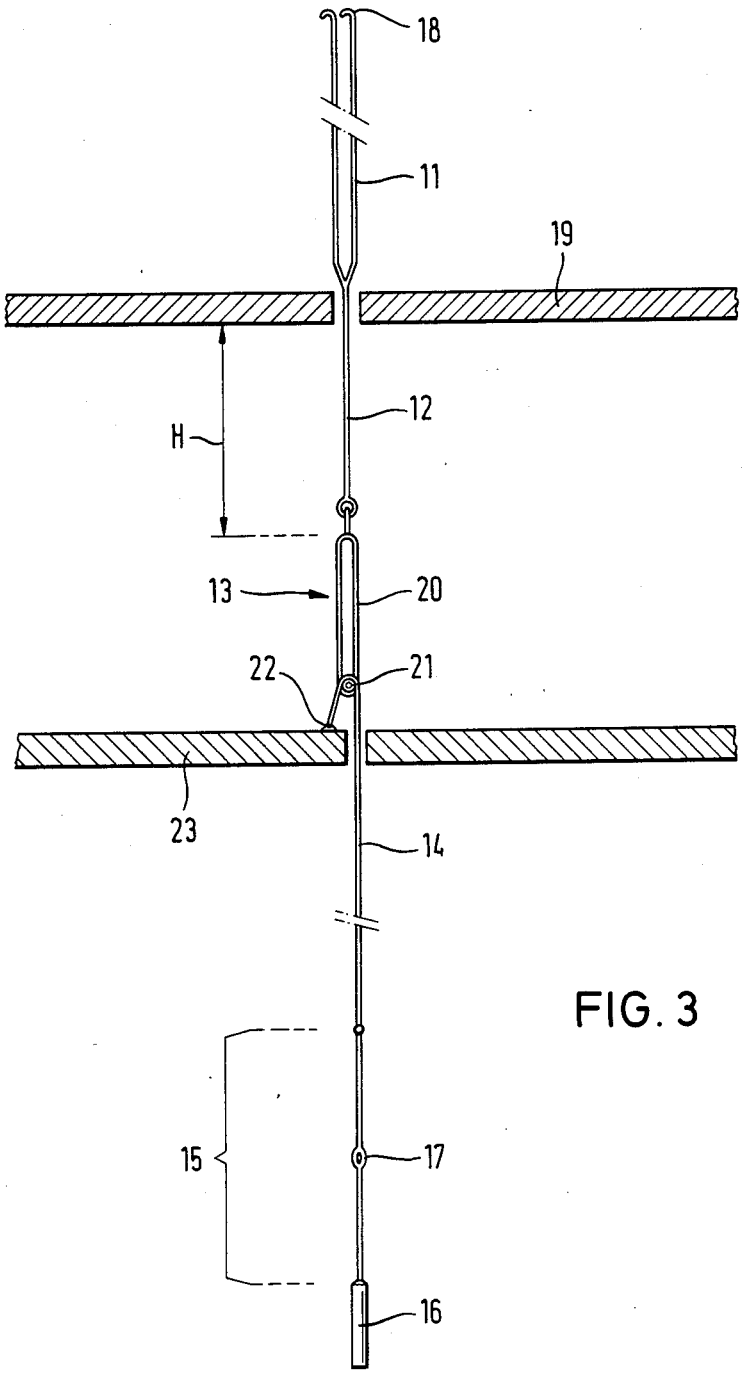
FIG. 3 is a diagrammatic cross-sectional view of a weaving harness for producing the construction of the invention shown in FIG. 2.

To form the shed when manufacturing the fabric according to the invention, a double-lift, fully-open shed Jacquard machine is preferably used. The connecting element between the loom and the Jacquard machine is the weaving harness. It transmits the control information of the Jacquard machine to the heddle. According to FIG. 3, the weaving harness suspended from the hook or notched plate 11 of the Jacquard machine is made up of a strap 12, a lifting pulley carrier 13, a harness cord 14, a pile strand 15 and a weight 16. The pile strand 15 contains a strand eye 17 through which a pile thread is threadable. The notched plate 11 is raised by means of a non-illustrated blade engaged into the hooks 18, through a stroke H necessary for forming the shed, and is again lowered. In the lowering operation, the hook or notched plate 11 can rest upon the plate floor 19. The lifting pulley carrier identified as a whole by reference numeral 13 includes sliding cheeks 20 and a lifting pulley 21 per se. The length of the sliding cheeks 20, like the length of the strap 12, should be greater than the lifting stroke H. By this dimensioning, the result is achieved that the lower end of the strap 12, when the appertaining hook or notched plate 11 is raised, is not pulled through the plate floor 19, and that mutually adjacent lifting pulley carriers 13, even in relative movement, always remain in an orderly arrangement and cannot get stuck one upon another. In the embodiment according to FIG. 3, it is essential that the harness cord 14 be guided over the lifting pulley 21 and be secured, with the upper end 22 thereof opposite the pile strand 15, to a part of the machine frame which may be identified as a harness carrier back support 23. When the hook or notched plate 11 is raised by the plate stroke H, the harness cord 14, the upper end 22 of which is fixed to the harness carrier back support 23, executes a stroke having a magnitude 2H, and the strand eye 17, together with the pole thread passed through it, is raised the same distance. In this manner, it is possible to combine a double-lift, fully-open shed Jacquard machine designed for the stroke H with a loom in such a manner that a shed having a height corresponding to a hook stroke of 2H may be formed, without overloading the Jacquard machine.

I claim:

1. A Jacquard double plush fabric for subsequent division into upper and lower fabric portions, comprising a plurality of weft yarn positions located in respective rows at respective outer and inner sides of the upper and lower farbic portions, with a single weft for each of said yarn positions and a pile warp thread looped about the respective weft yarn positions, and groups of floating warp threads woven into and distributed within the upper and the lower fabric portions and extending in a given direction, each of said weft yarn positions being the only yarn position located in a respective plane extending perpendicularly to said given direction of said floating warp threads, said weft yarn positions at outer sides and said weft yarn position at said inner sides being disposed on pairs alternatingly in said given direction of the floating warp threads extending perpendicularly to said wefts, said weft yarn positions of each of the pairs thereof at said outer sides being offset from one another and from each of the weft yarn positions at said inner sides in said given direction of the floating warp threads, and said weft yarn positions of each of the pairs thereof at said inner sides being offset from one another and from each of the weft yarn positions at said outer sides in said given direction of the floating warp threads.

2. A double plush fabric according to claim 1 wherein a continuous pile thread forming part of the upper and the lower fabric portions extends alternately into the upper and the lower fabric portions, said continuous pile thread extending around a continuous series of weft sequences, each of said weft sequences including two lower wefts of the upper and the lower fabric portions and two upper wefts of the upper and the lower fabric portions, at least one floating thread of said groups thereof extending between respective adjacent upper and lower wefts of each of said weft sequences, respective lower and upper wefts of the upper and lower fabric portins binding in said floating thread groups and securing the U-shaped pile threads.

3. A double plush fabric according to claim 1 wherein the upper and the lower fabric portions have respective pile sides facing towards one another and respective outer sides opposite to the respective pile sides thereof, respective weft threads being located at both said pile sides and side outer sides of the upper and the lower fabric portions, the weft threads at said outer sides being approximately double the thickness of the weft thread at said pole sides.

4. A Jacquard double plush fabric for subsequent division into upper and lower fabric portions, comprising a plurality of weft yarn positions located in respective rows at respective outer and inner sides of the upper and lower fabric portions, with a single weft for each of said yarn positions and a pile warp thread looped about the respective single weft, and groups of floating warp threads woven into and distributed within the upper and the lower fabric portions and extending in a given direction, said weft yarn positions at said outer sides and said weft yarn position at said inner sides being disposed in pairs alternatingly in said given direction of the floating warp threads extending perpendicularly to said wefts, said weft yarn positions of each of the pairs thereof at said outer sides being offset from one another and from each of the weft yarn positions at said inner sides in said given direction of the floating warp threads, and said weft yarn positions of each of the pairs thereof at said inner sides being offset from one another and from each of the yarn positions at said outer sides in said given direction of the floating warp threads.

* * * * *